United States Patent [19]

Ehrenberg et al.

[11] 3,943,678

[45] Mar. 16, 1976

[54] GAP-SEALING STRUCTURE

[75] Inventors: Kurt Ehrenberg, Dietzenbach; Klaus Wörner, Frankfurt-Seckbach, both of Germany

[73] Assignee: Heinrich Wörner Fabrik Für Autoteile, Frankfurt, Germany

[22] Filed: Feb. 11, 1974

[21] Appl. No.: 441,623

[30] Foreign Application Priority Data

Feb. 13, 1973 Germany ..... 2306964

[52] U.S. Cl. ..... 52/461; 52/584

[51] Int. Cl.[2] ..... E04D 1/36

[58] Field of Search ..... 52/459, 460, 461, 463, 52/464, 480, 396, 403, 584

[56] References Cited

UNITED STATES PATENTS

| | | | |
|---|---|---|---|
| 2,102,902 | 12/1937 | Lenke | 52/461 X |
| 2,145,469 | 1/1939 | Weinland | 52/584 X |
| 2,842,073 | 7/1958 | Huston et al. | 52/461 X |
| 3,028,938 | 4/1962 | Schorr | 52/459 X |
| 3,173,224 | 3/1965 | Aagard | 52/461 X |
| 3,263,385 | 8/1966 | Pauls | 52/461 |
| 3,339,329 | 9/1967 | Berg | 52/460 X |
| 3,350,828 | 11/1967 | Russell | 52/464 X |
| 3,552,704 | 1/1971 | Pond | 52/464 X |

*Primary Examiner*—Ernest R. Purser
*Attorney, Agent, or Firm*—Michael J. Striker

[57] ABSTRACT

A pair of panels is located substantially in a common plane, the panels having juxtaposed edge portions bounded by edge faces which define with one another an elongated gap. Elastically yieldable sealing strips overlie tne gap and the edge portions at opposite sides of the common plane, and pressure-exerting elements press these sealing strips into sealing engagement with the edge portions in order to seal the gap.

22 Claims, 14 Drawing Figures

GAP-SEALING STRUCTURE

BACKGROUND OF THE INVENTION

The present invention relates generally to a gap-sealing structure, and more particularly to such structure which is especially suitable for sealing the gaps between the panels of roofs and the like.

Building roofs must be tightly sealed against the entry of moisture, a problem which presents particular difficulties where flat roofs are involved. Unlike inclined roofs where a roof covering can be overlapped so that water which runs down over the roof cannot enter into gaps between adjacent roof covering elements, this is not possible in flat roofs. Heretofore, flat roofs were usually sealed by placing upon them several layers of roofing felt which are adhered together. Usually, a layer of gravel is then placed on top to protect the roofing felt against deterioration as much as possible.

Another approach that has become known in the prior art is to cover the entire roofing surface with watertight foils, for instance of synthetic plastic material. In this case also the roof is usually provided with a final layer of gravel in order to protect the foil against the damaging influences of the ambient atmosphere, and also to prevent the foil from being lifted off in the event of high winds.

Both of these prior-art approaches are highly successful, and as a general rule will provide the desired sealing of the roof. They do, however, have certain disadvantages. In particular, roofs which are so covered cannot support any significant weight and cannot, therefore, be used as patios, terraces or the like. This can cause a substantial loss of potentially available valuable space. Another difficulty is the fact that these roofs are relatively expensive in terms of the material costs involved, as well as the time and labor expenses for installing them. Another disadvantage results from the inclusion in the roofing substances of organic materials which are subject to destruction under atmospheric influences, heat, moisture, and radiation, and which also support combustion.

To overcome the aforementioned disadvantages, roofs in general, and flat roofs in particular, should ideally be made of rigid panels that are capable of supporting weight and are composed of inorganic materials, such as asbestos cement, concrete, reinforced glass, metal or the like. However, as has already been pointed out earlier, attempts at using such panels without overlying layers of roofing felt or foils have been unsuccessful because the gaps between adjacent ones of the panels have heretofore never been satisfactorily sealed against the entry of moisture. It was attempted to fill the gaps with sealing materials, for instance synthetic plastic material. However, the volumetric content of these gaps is relatively small, since the panels are not very thick and must not be installed too far apart. This means that it is not possible to introduce a substantial amount of sealing material into the gaps and the amount that can be so introduced is not sufficient to withstand the stresses which act upon it when the roof panels are subject to thermal expansion and contraction. It was observed that ever after a brief period of time following the installation, cracks developed in the sealing material, permitting the entry of water into the gap and into the underlying structure beneath the roof. Moreover, because the introduction of the sealing material into the gaps must take place in the open, the presence of moisture during the introduction could often not be precluded, and this led to improper bonding of the sealing material with the panels. For this reason, the inherently advantageous use of roof panels without any necessity for overlying layers of roofing felt or foils, have not found any introduction in actual practice until now.

SUMMARY OF THE INVENTION

It is a general object of the present invention to overcome these disadvantages of the prior art.

More particularly, it is an object of the present invention to provide a gap-sealing structure which avoids the aforementioned disadvantages.

An additional object of the invention is to provide such a gap-sealing structure which permits the use of panels for roofing constructions.

Another object of the invention is to provide such a gap-sealing structure which is economical to employ and can be used and installed in all weather conditions.

Furthermore, another object of the invention is to provide such a gap-sealing structure which can be used with any type of roofing panel, and which particularly makes it possible to use non-flammable or at least flame-retarding roofing panels for the construction of roofs which are watertight.

In keeping with the above objects, and with others which will become apparent hereafter, one feature of the invention resides, in a structure of the character described, in a combination which comprises a pair of panels located substantially in a common plane and having juxtaposed edge portions bounded by edge faces which define with one another an elongated gap. Elastically yieldable sealing strip means extends along and covers the gap and the edge portions. Pressure-exerting means presses the sealing strip means into sealing engagement with the edge portions so as to seal the gap.

It is now possible to use inorganic panels, such as panels of concrete or the like, for the roofing construction. Such panels either do not support combustion or are very difficult to ignite, and the gaps between them can now be reliably sealed against the entry of moisture. The installation the like, for the roofing construction. Such panels either do not support combustion or are very difficult to ignite, and the gaps between them can now be reliably sealed against the entry of moisture. The installation of the seal is rapid, simple and inexpensive, and thus presents a further advantage over the prior-art constructions.

It is possible to use rails of substantially U-shaped cross section each having an open side which faces the gap and the edge portions of the panels, and to accommodate in these rails respective strips of pre-compressed sealing material. Such material is advantageously of the swellable type, that is due to its precompression and resulting swelling it will tightly and sealingly engage the edge portions of the panels and also enter sealingly into the respective gap. It is possible to provide a single such strip at one side of the common plane in which the pair of panels is located, or that two strips can be provided, one at either side of the plane. The sealing material of the strips may include a substance which enables it, when confined in the rails and precompressed therein, to exert a substantial sealing pressure —for instance on the order of several hundred grams per square centimeter—upon the edge portions of the panels, and to maintain this material at a constant degree of elastic deformability. This makes it possible for the sealing material to increase its volume by more than double after its installation.

The sealing material may however also be of elastomeric material, that is natural or synthetic rubber or the like, or it may be synthetic foam material which of course should be impermeable to water. In this case it is not necessary to provide rails for the sealing strips.

The rails themselves can have various different configurations as will become evident from the following detailed description.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

Figure 2:
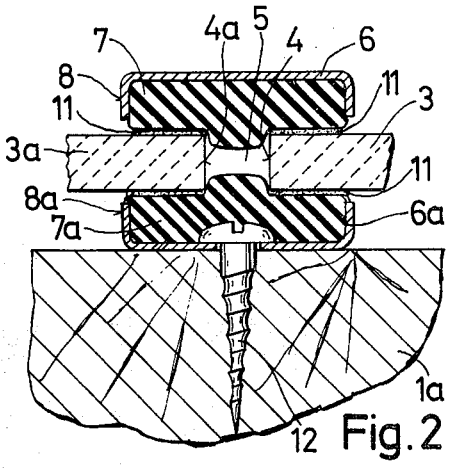
Figure 3:
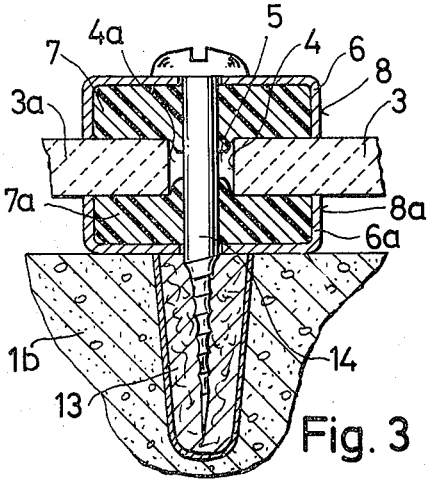
Figure 4:
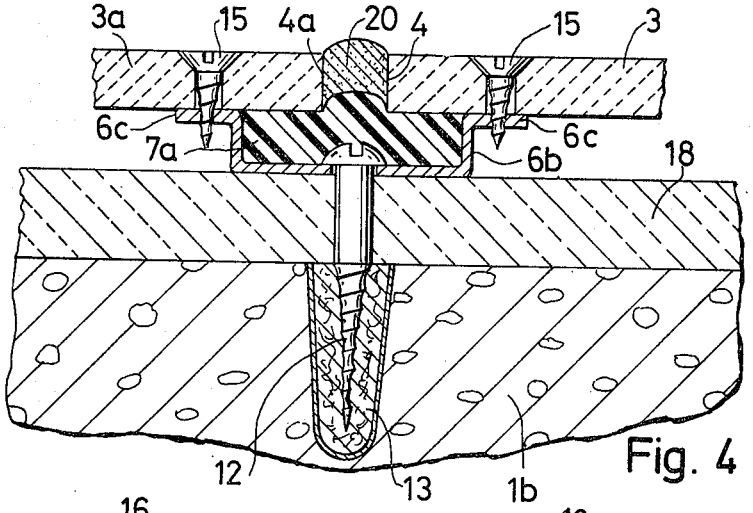
Figure 5:
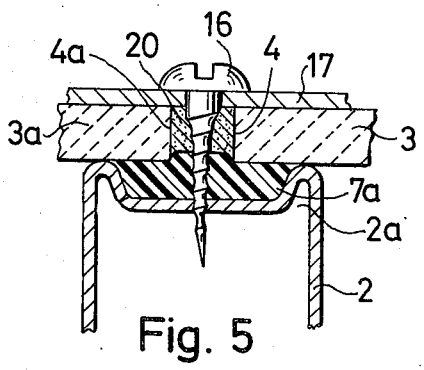
Figure 6:
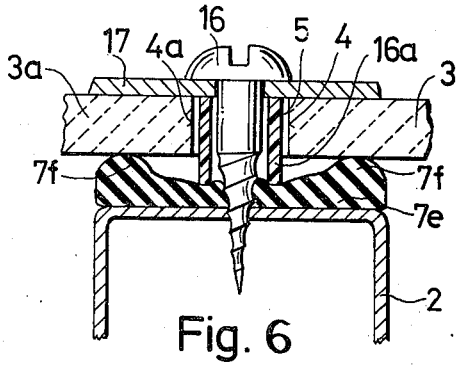

FIGS. *1a–1d* are diagrammatic sections illustrating various different components for use in accordance with the invention;

FIG. 2 is a view of a further embodiment of the invention, in a vertical section;

FIG. 3 is a view similar to FIG. 2, illustrating another embodiment of the invention;

FIG. 4 is a view similar to FIG. 3, illustrating an additional embodiment of the invention;

FIG. 5 is a view similar to FIG. 4, illustrating yet another embodiment of the invention;

FIG. 6 is a view similar to FIG. 5, illustrating still an additional embodiment of the invention;

FIGS. *7a* and *7b* are cross sections through different sealing strips according to the invention; and FIGS. *7c* and *7d* are cross sections illustrating how the sealing strip of FIG. *7a* can be employed.

DESCRIPTION OF THE PREFERRED EMBODIMENT

Figure 1:
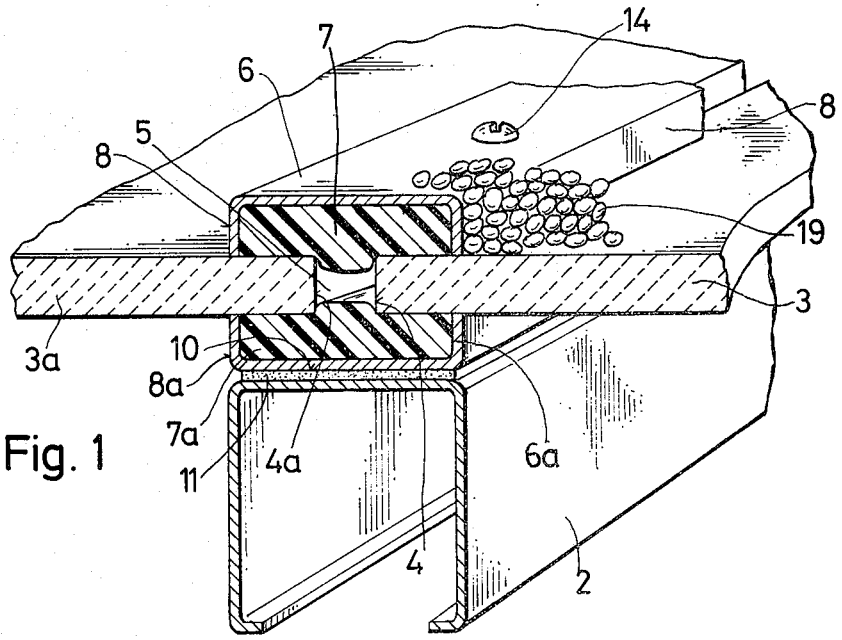
FIG. 1 is a fragmentary partly perspective section illustrating one embodiment of the invention.
Figure 1A:
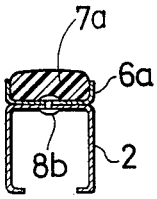
Figure 1B:
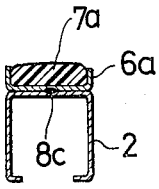
Figure 1C:
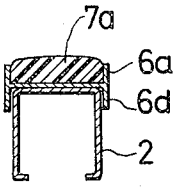
Figure 1D:
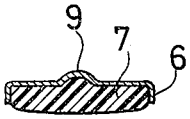

Referring firstly to FIG. 1 it will be seen that in this Figure we have illustrated two panels 3, *3a* which may be of any suitable inorganic material, for instance asbestos cement or the like. These are panels that can be used for roofing purposes, that is they will have sufficient strength to permit the construction of a roof on which it is possible to walk, stand or in general place weight. The edge faces 4, *4a* of the panels extend along the juxtaposed edge portions of the panels and define with one another an elongated gap 5 which must be wide enough to permit thermal expansion and contraction of the panels 3, *3a* themselves and any associated structures, for instance the support structure 2 on which the edge portions rest. These movements may be quite substantial and very often constitute the real reason for leaks in roofs.

The supporting structure 2 in FIG. 1 is a profiled element which may be of metal, synthetic plastic material, concrete or the like. It will be placed upon the underlying supporting structure of the roof, for instance roof beams or the like (not shown) before the panels 3, *3a* are installed.

In the embodiment shown in FIG. 1 a substantially U-shaped rail *6a* having an upwardly facing open side is secured to the support structure 2 by means of a layer of adhesive 11 for instance, acrylate-polyacrylate-rubber adhesive, which bonds its transverse wall 10 to the structure 2. Located within the rail *6a* is a sealing strip *7a* of swellable sealing material which is pre-compressed when it is inserted into the rail *6a*, that is in non-compressed state the dimensions of the strip *7a* will be larger than the interior dimensions of the rail *6a*. The edge portions of the panels 3, *3a* are supported on the strip *7a* so that their edge faces 4, *4a* define with one another the gap 5. Located above the common plane in which the panels 3, *3a* are located, is another rail 6 similar to the rail *6a* but having its open side facing downwardly towards the panels 3, *3a*. It, also, accommodates a sealing strip 7 of swellable sealing material. Screws 14 extend through the rails 6, *6a* into the support structure 2, exerting a pressure upon the sealing strips 7, *7a* so that the latter are in part forced to enter the gap 5 and over the remainder of their surfaces which are juxtaposed with the panels 3, *3a* tightly and sealingly engage the edge portions of these panels.

We have found it to be advantageous if the swellable sealing material is of the type which is capable of developing its own sealing pressure following its pre-compressure at which it presses against the panels 3, *3a*, and of maintaining its elasticity for long periods of time. Such materials are commercially available under the trade name "Silpress", for example, polyurethane-polyester foam together with polyacrylate-rubber, which is a type of material which can exert a sealing pressure of several hundred grams per square centimeter and which can increase its volume by more than double, for instance up to 300%. In order to be able to employ this volume increase to fill or substantially fill the gap 5, the use of swellable sealing material will always be combined according to the invention with the use of rails 6 and/or *6a* having the essentially U-shaped configuration that is shown in FIG. 1 and having the side walls 8 which prevent lateral yielding of the material of the sealing strips 7, *7a*.

FIG. *1a* shows that instead of the adhesive material 11 that is used in FIG. 1 to secure the rail *6a* to the support structure 2, the rail *6a* could also be secured to the support structure 2 by means of rivets *8b* (one shown). Another possibility is shown in FIG. *1b*, where the rivet *8b* is replaced by one or more welds *8c*, which can be in form of a continuous weld or spot welds. FIG. *1c* shows that the rail *6a* could be provided with laterally extending projections *6d* which could straddle and tightly frictionally engage the support structure 2, and FIG. *1d* shows that an upper rail 6 (compare FIG. 1) could be provided with one or could straddle and tightly frictionally engage the support structure 2, and FIG. *1d* shows that an upper rail 6 (compare FIG. 1) could be provided with one or more (one shown) longitudinally extending beads 9 for reinforcing purposes. Other configurations can of course also be employed within the concept of the invention.

In FIG. 2 we have shown a further embodiment in which the lower rail *6a* is supported directly upon a wooden support structure *1a*, such as a roof or the like, where it is secured by means of screws 12. In this embodiment the sealing strips 7, *7a* are of non-swellable sealing material e.g. and the panels 3, *3a* can be secured to the strips 7, *7a* by means of adhesive layers 11. The holes for the screws 12 can be pre-drilled, using an appropriate template or the like and thereupon the screws 12 are inserted through the holes which have been provided for this purpose in the rail *6a* and are threaded into the support structure 1*a*. Subsequently, the panels 3, 3*a* are put in place, with adhesive material 11 being interposed, additional adhesive material is placed on top of the panels 3, 3*a* as shown, and the rail 6 with the sealing strip 7 is then put in place. In this embodiment it is, of course, the rails 6, 6*a* which exert pressure upon the sealing strips.

FIG. 3 shows another embodiment in which screws 14 are used which extend through the upper rail 6, the sealing strip 7, the gap 5, the sealing strip 7*a*, the lower rail 6*a* and into a supporting structure 1*b* which may be concrete or the like and in which an anchor such as a wall plug or the like —identified with reference numeral 13— is inserted to provide for better retention. The material of the sealing strips here can be of the swellable type or of the non-swellable type.

Evidently, the embodiment of FIG. 3 could also utilize a support such as the support 2 of FIG. 1, instead of the support structure 1*b*, or it could be employed in the support structure 1*a* of FIG. 2 if desired. The rail 6*a* could also be directly adhesively connected by means of the layer 11 to the support structure 1*b* or to the support structure 1*a* of FIG. 2, if desired, with or without the use of the screws 14.

In the embodiment of FIG. 4, the support structure is again identified with reference numeral 1*b* as a concrete structure. Here, a sealing strip 7*a* is provided only beneath the gap 5, and none above it. The strip 7*a* is advantageously but not necessarily of swellable sealing material. A layer 18 of thermally insulating material is placed on top of the structure 1*b* and a rail 6*b* having an upwardly facing open side bounded by outwardly extending flanges 6*c*, is secured on top of the layer 18 by means of screws 12 (one shown) which extend into the support structure 1*b* and into an appropriate expansion anchor 13 provided for this purpose. A sealing strip 7*a* of swellable sealing material is accommodated in the interior of the rail 6*b*, and the panels 3, 3*a* are screwed to the flanges 6*c* by means of of screws 15. Thus, the panels exert pressure upon the sealing strip 7*a* to thereby produce the desired sealing engagement. In this embodiment, in which the sealing strip 7*a* is located only beneath the gap 5, with some of the material of the strip 7*a* being forced into the gap 5, the remainder of the gap is filled with a compound 20 that is intended to protect the material of the strip 7*a* against contact with ozone and UV radiation which both tend to have a deteriorating effect on the material of the strip 7*a*. The compound 20 may be a synthetic plastic material which is well known in this art.

Of course, it would be possible to omit the rail 6*b* shown in FIG. 4, and to use the rail 6*a* from the preceding embodiments, and it would also be possible to install either the illustrated embodiment of FIG. 4 or the modified one just mentioned on a support 2 instead of on the concrete structure 1*b*.

The embodiment of FIG. 5 shows a somewhat modified version of the FIG. 4 concept. Here, a support 2 is provided having in its upper region 2*a* a downwardly formed depression so that the support 2 in effect includes an integrally formed rail corresponding to the rail 6*a*. The sealing strip 7*a* is located in this depression and the panels 3 and 3*a* are positioned as discussed earlier. Here, however, screws 7 are used which are threaded through the gap 5 into the transverse wall which in part bounds the space wherein the strip 7*a* is located. The heads of the screws 16 bear upon washers 17 (which could also be strips extending longitudinally of the gap 5) which are supported on the opposite edge portions of the panels 3, 3*a* and exert pressure via the same upon the sealing strip 7*a*. Compound 20, such as a polyacrylate-rubber compound, is still accommodated in the gap 5, to completely fill the latter and if necessary provide protection against contact of ozone and UV radiation with the material of the sealing strip 7*a*.

In FIG. 6 we have shown an embodiment wherein a support 2 corresponding to the one of FIG. 1 is utilized, a sealing strip 7*e* of non-swelling sealing material, such as natural or synthetic rubber or the like, being located on top of the support 2. The strip 7*e* has two beads 7*f* which extend along its opposite lateral sides and project upwardly into engagement with the panels 3, 3*a*. Screws 16 and washers 17 correspond to those used in FIG. 5. In this embodiment, however, each screw 16 has associated with it a pressure sleeve 16*a* which surrounds the shaft of the screw in the gap 5 and bears with its upper end against the respective washer 17 and with its lower end against the material of the sealing strip 7*e*, forcing this material inwardly into the screw threads of the screw to obtain a reliable seal against the entry of moisture along the screw threads. The material of the sealing strip 7*e* may be a synthetic plastic foam material, which of course should be water-impermeable, meaning that it should be of the closed-cell type.

Figure 7A:
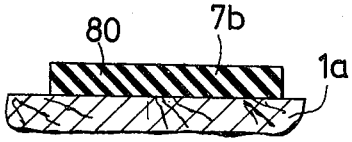

FIG. 7*a* is a cross section through a further sealing strip 7*b* which may be of the same material as the sealing strip 7*e* in FIG. 6 and in uncompressed condition is of rectangular cross section. It is intended only for use in applications where the sealing strip is provided only at the underside of the panels 3, 3*a*, as for instance in FIG. 4.

Figure 7B:
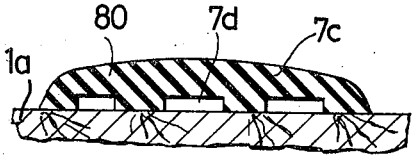

FIG. 7*b* shows a sealing strip 7*c* which is formed at its underside with longitudinally extending grooves 7*d*, the purpose of these being to facilitate its compression.

Figure 7C:
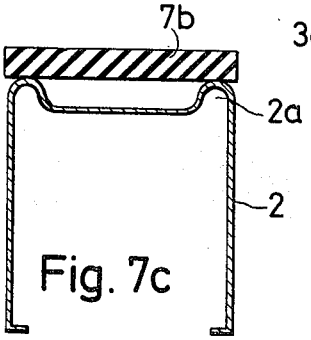

FIG. 7*c* shows the sealing strip 7*b* of FIG. 7*a* in uncompressed condition on top of a support 2 of the type used in FIG. 5, and it will be understood that when the strip 7*b* is compressed, it will be partly pressed into the recess formed in the region 2*a*, whereas the portions which project upwardly in the region 2*a* will press the material of the strip 7*b* against the overlying panels 3, 3*a*.

Figure 7D:
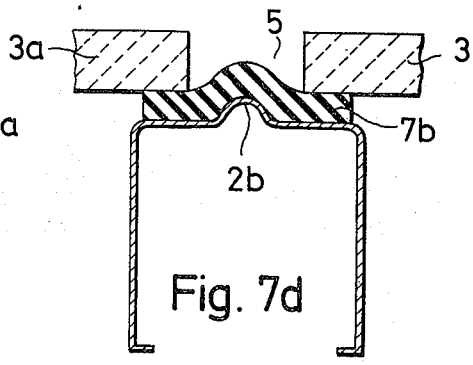

The embodiment of FIG. 7*d*, finally, shows that the support 2 could also be provided at its upper transverse wall with an upwardly projecting longitudinally extending bead 2*b* which presses the sealing strip 7*b* into the gap 5 formed between the panels 3, 3*a* when the panels are pressed downwardly against the support 2.

The sealing strips 7*b*, 7*e* and 7*c* need not be accommodated in and engaged by rails 6, 6*a*, 6*b* or the like.

According to a further embodiment which is not illustrated, rails 6*b* with the flanges 6*c* (as used in FIG. 4) could also be arranged above the panels 3, 3*a*. Since they would project above the upper surface of the panels 3, 3*a*, as indeed does the rail 6 in FIG. 1, a layer of gravel which is diagrammatically indicated at 19 in FIG. 1, may be poured on top of the roof construction to provide a level upper surface.

It will be understood that each of the elements described above, or two or more together, may also find a useful application in other types of constructions differing from the types described above.

While the invention has been illustrated and described as embodied in a gap-sealing structure, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features which, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

1. In a structure comprising a pair of panels located substantially in a common plane and having juxtaposed edge portions bounded by edge faces which define with one another an elongated gap at least one rail of substantially U-shaped cross section which has an open side facing said gap and edge portions at one side of said plane, said rail having flanges extending transversely from said open side and contacting the respective edge portions, adhesive means adhesively bonding said flanges of said rail to the respective edge portion; elastically yieldable sealing strip means extending along and covering said gap and edge portions and including a sealing strip recessed in said rail; and pressure-exerting means pressing said sealing strip means into sealing engagement with said edge portions so as to seal said gap.

2. A combination as defined in claim 1, wherein said panels are roof panels of a building roof.

3. A combination as defined in claim 1, wherein said pressure-exerting means comprises screw means.

4. A combination as defined in claim 1 wherein said sealing means comprises a pair of sealing strips, one of said sealing strips covering said gap and marginal portions and the other sealing strip covering said gap at said exposed surface.

5. A combination as defined in claim 1, wherein said sealing means is means is of swellable sealing material of inherent elasticity which exerts sealing pressure upon said marginal portions of said panels.

6. A combination as defined in claim 1 wherein said sealing strip means is composed of non-swelling sealing material; and further comprising adhesive means adhesively bonding said sealing strip means to said edge portions of said panels.

7. A combination as defined in claim 1, wherein said sealing means is composed of an elastomeric material.

8. A combination as defined in claim 7, wherein said sealing means comprises at least one sealing strip of said elastomeric material, said sealing strip being in uncompressed condition of rectangular cross section.

9. A combination as defined in claim 1, wherein said sealing means is composed of synthetic plastic foam material.

10. A combination as defined in claim 1, wherein said sealing strip means comprises a sealing strip at one side of said plane; and further comprising a sealing compound at least partly filling said gap at the other side of said plane.

11. In a structure of the character described, a combination comprising a pair of panels located substantially in a common plane and having juxtaposed edge portions bounded by edge faces which define with one another an elongated gap; elastically yieldable sealing strip means extending along and covering said gap and edge portions and including at least one sealing strip of swellable sealing material; and pressure-exerting means pressing said sealing strip means into sealing engagement with said edge portions so as to seal said gap, and including a plurality of screws extending through said gap and threaded through said sealing strip into an underlying support, a washer intermediate a head of the respective screw and said edge portions and bearing upon the latter, and a pressure-exerting sleeve surrounding each screw in said gap intermediate the associated washer and said sealing strip so as to exert pressure upon the latter.

12. A combination as defined in claim 11, wherein said sealing strip has longitudinally extending margins provided with raised beads which face towards and are in sealing contact with respective ones of said edge portions.

13. In a structure of the character described, a combination comprising an elongated rail including two lateral wall portions and a transverse wall portion interconnecting said lateral wall portions and bounding therewith a recess extending longitudinally of said rail, said lateral wall portions having free ends spaced from said transverse wall portion and having end surfaces; a pair of panels located substantially in a common plane and having edge portions juxtaposed with said end surfaces and bounded by edge faces which extend substantially normal to said common plane and define with one another an elongated gap between said panels extending parallel to said recess and in communication therewith; an additional rail similar to said rail, said rail and additional rail being located at opposite sides of said plane, respectively, and each having an open side facing said gap and edge portions; elastically yieldable precompressed sealing means received in said recesses and in contact with said wall portions and including a pair of sealing strips, each of said strips being accommodated in one of said rails in partially compressed condition, one of said sealing strips covering said gap and edge portions at one side of said plane and the other sealing strips covering said gap and edge portions at the other side of said plane; and pressure exerting means connecting said panels to said elongated rails and pressing said edge portions into sealing engagement with said precompressed sealing means so that said sealing means sealingly penetrates into said gap.

14. A combination as defined in claim 13, wherein at least one of said rails is formed with a longitudinally extending reinforcing bead.

15. A combination as defined in claim 13, wherein said pressure-exerting means comprises screws extending through said rails and securing the same to a support.

16. In a structure of the character described, a combination comprising an elongated rail including two lateral wall portions and a transverse wall portion interconnecting said lateral wall portions and bounding therewith a recess extending longitudinally of said rail, said lateral wall portions having free ends spaced from said transverse wall portion and having end surfaces, said trahsverse wall portion facing a support; adhesive means adhesively bonding said transverse wall portion to said support; a pair of panels located substantially in a common plane and having edge portions juxtaposed with said end surfaces and bounded by edge faces which extend substantially normal to said common plane and define with one another an elongated gap between said panels extending parallel to said recess and in communication therewith; elastically yieldable precompressed sealing means received in said recess and in contact with said wall portions; and pressure exerting means connecting said panels to said elongated rail and pressing said edge portions into sealing engagement with said precompressed sealing strip means so that said sealing strip means sealingly penetrates into said gap.

17. A combination as defined in claim 16, wherein said sealing means is composed of water-impermeable synthetic plastic foam material.

18. In a structure of the character described, a combination comprising an elongated rail including two lateral wall portions and a transverse wall portion interconnecting said lateral wall portions and bounding therewith a recess extending longitudinally of said rail, said lateral wall portions having free ends spaced from said transverse wall portion and having end surfaces, said rail overlying and being located on a support; screw means securing said rail to said support a pair of panels located substantially in a common plane and having edge portions juxtaposed with said end surfaces and bounded by edge faces which extend substantially normal to said common plane and define with one another an elongated gap between said panels extending parallel to said recess and in communication therewith; elastically yieldable precompressed sealing means received in said recess and in contact with said wall portions; and pressure exerting means connecting said panels to said elongated rail and pressing said edge portions into sealing engagement with said precompressed sealing strip means so that said sealing strip means sealingly penetrates into said gap.

19. In a structure of the character described, a combination comprising an elongated rail including two lateral wall portions and a transverse wall portion interconnecting said lateral wall portions and bounding therewith a recess extending longitudinally of said rail, said lateral wall portions having free ends spaced from said transverse wall portion and having end surfaces, said rail overlying and being located on a support; rivet means securing said rail to said support; a pair of panels located substantially in a common plane and having edge portions juxtaposed with said end surfaces and bounded by edge faces which extend substantially normal to said common plane and define with one another an elongated gap between said panels extending parallel to said recess and in communication therewith; elastically yieldable precompressed sealing means received in said recess and in contact with said wall portions; and pressure exerting means connecting said panels to said elongated rail and pressing said edge portions into sealing engagement with said precompressed sealing strip means so that said sealing strip means sealingly penetrates into said gap.

20. In a structure of the character described, a combination comprising an elongated rail including two lateral wall portions and a transverse wall portion interconnecting said lateral wall portions and bounding therewith a recess extending longitudinally of said rail, said lateral wall portions having free ends spaced from said transverse wall portion and having end surfaces, said rail overlying and being located on a support; weld means securing said rail to said support; a pair of panels located substantially in a common plane and having edge portions juxtaposed with said end surfaces and bounded by edge faces which extend substantially normal to said common plane and define with one another an elongated gap between said panels extending parallel to said recess and in communication therewith; elastically yieldable precompressed sealing means received in said recess and in contact with said wall portions; and pressure exerting means connecting said panels to said elongated rail and pressing said edge portions into sealing engagement with said precompressed sealing strip means so that said sealing strip means sealingly penetrates into said gap.

21. In a structure of the character described, a combination comprising a support; an elongated rail including two lateral wall portions and a transverse wall portion interconnecting said lateral wall portions and bounding therewith a recess extending longitudinally of said rail, said lateral wall portions having free ends spaced from said transverse wall portion and having end surfaces, said rail overlying said support and comprising projections which engage said support and removably retain said rail on the same; a pair of panels located substantially in a common plane and having edge portions juxtaposed with said end surfaces and bounded by edge faces which extend substantially normal to said common plane and define with one another an elongated gap between said panels extending parallel to said recess and in communication therewith; elastically yieldable precompressed sealing means received in said recess and in contact with said wall portions; and pressure exerting means connecting said panels to said elongated rail and pressing said edge portions into sealing engagement with said precompressed sealing strip means so that said sealing strip means sealingly penetrates into said gap.

22. In a structure of the character described, a combination comprising an elongated rail constituting a support and including two lateral wall portions, a pair of side walls and a transverse wall portion interconnecting said lateral wall portions and bounding therewith a recess extending longitudinally of said rail, said lateral wall portions having free ends spaced from said transverse wall portion and having end surfaces; a pair of panels located substantially in a common plane and having edge portions juxtaposed with said end surfaces and bounded by edge faces which extend substantially normal to said common plane and define with one another an elongated gap between said panels extending parallel to said recess and in communication therewith, said transverse wall portion facing said panels, and said side walls extending from said transverse wall portion in direction away from said panels; elastically yieldable precompressed sealing means received in said recess and in contact with said wall portions; and pressure exerting means connecting said panels to said elongated rail and pressing said edge portions into sealing engagement with said precompressed sealing strip means so that said sealing strip means sealingly penetrates into said gap.

* * * * *